US005152458A

United States Patent [19]

Curtis

[11] Patent Number: 5,152,458

[45] Date of Patent: Oct. 6, 1992

[54] AUTOMATICALLY ADJUSTABLE FLUID DISTRIBUTOR

[76] Inventor: Harold D. Curtis, Rte. 2, Box 139, Chickasha, Okla. 73018

[21] Appl. No.: 792,968

[22] Filed: Nov. 15, 1991

Related U.S. Application Data

[63] Continuation-in-part of Ser. No. 714,848, Jun. 13, 1991.

[51] Int. Cl.[5] ..... B05B 3/04; B05B 3/10; B05B 1/26; B05B 1/32

[52] U.S. Cl. ..... 239/222.17; 239/224; 239/456; 239/498; 239/500; 239/514; 261/89; 261/111; 261/DIG. 11

[58] Field of Search ..... 239/DIG. 1, 222.17, 239/222.19, 224, 505, 520, 498, 500, 501, 524, 513, 514, 437, 438, 439, 440, 441, 451, 453, 456, 457, 460, 461, 516, 506; 261/89, 111, DIG. 11

[56] References Cited

U.S. PATENT DOCUMENTS

| | | | |
|---|---|---|---|
| 409,796 | 8/1889 | Magaldi | 239/204 X |
| 442,865 | 12/1890 | DeKinder | 239/224 |
| 533,747 | 2/1895 | Ritter | 239/240 X |
| 556,040 | 3/1896 | Alberger | 261/95 |
| 621,718 | 3/1899 | Seymour, Jr. | 261/8 |
| 727,461 | 5/1903 | Schreuder | 261/111 |
| 889,424 | 6/1908 | Adams | 239/514 |
| 960,732 | 6/1910 | Taylor | 239/514 |
| 976,246 | 11/1910 | Alberger | 261/25 |
| 1,002,748 | 9/1911 | Pauling | 239/514 |
| 1,149,810 | 8/1915 | Crosbie | 239/223 |
| 1,225,889 | 5/1917 | Thomas | 261/103 |
| 1,433,159 | 10/1922 | Sharp | 239/214.13 |
| 1,926,970 | 9/1933 | Cline | 261/112.1 |
| 1,931,689 | 10/1933 | Evans | 239/DIG. 1 |
| 2,007,675 | 7/1935 | Erikson et al. | 239/439 |
| 2,176,243 | 10/1939 | Braungart | 239/240 |
| 2,446,918 | 8/1948 | Goddard | 239/514 |
| 2,568,875 | 9/1951 | Wethly et al. | 261/111 |
| 3,144,034 | 8/1964 | Lyman et al. | 239/222.17 |
| 3,189,283 | 6/1965 | Moore | 239/222.17 |
| 3,397,842 | 8/1968 | Frandsen | 239/206 |
| 3,767,177 | 10/1973 | Engalitcheff, Jr. et al. | 261/116 |
| 4,132,362 | 1/1979 | Hyde et al. | 239/506 |
| 4,267,130 | 5/1981 | Curtis | 261/112.1 |
| 4,301,097 | 11/1981 | Curtis | 261/109 |
| 4,437,611 | 3/1984 | Gilroy | 239/506 |
| 4,991,780 | 2/1991 | Kannan et al. | 239/513 |

FOREIGN PATENT DOCUMENTS

| | | | |
|---|---|---|---|
| 542371 | 1/1942 | United Kingdom | 239/453 |

OTHER PUBLICATIONS

Brochure of Munters Co. of Fort Myers, Fla., entitled "dek-SPRAY ® Nozzles" (undated but admitted to be prior art).

Brochure of Bete Fog Nozzle, Inc., of Greenfield, Mass., entitled "Series NCSQ" (undated but admitted to be prior art).

Brochure of Spraying Systems Co. of Wheaton, Ill. (undated but admitted to be prior art).

Photograph of C. E. Shepherd Co., Inc. device (undated but admitted to be prior art).

Photograph of Ecodyne device (undated but admitted to be prior art).

*Primary Examiner*—Andres Kashnikow
*Assistant Examiner*—Lesley D. Morris
*Attorney, Agent, or Firm*—Laney, Dougherty, Hessin & Beavers

[57] ABSTRACT

A fluid distributing apparatus provides a fountain-type distributor which effects substantially uniform radial distribution of fluid across a spray pattern. An irregular spaced annular nozzle opening is provided for deflecting the spray pattern into a non-circular pattern, and in a preferred case into a square pattern. Also, an automatic adjustment varies the spacing around the entire nozzle opening to accommodate varying supply pressures. The distributor is particularly suited for use in industrial cooling towers to increase the efficiency of the cooling towers by increasing the uniformity of water distribution across the fill material of the cooling tower.

22 Claims, 9 Drawing Sheets

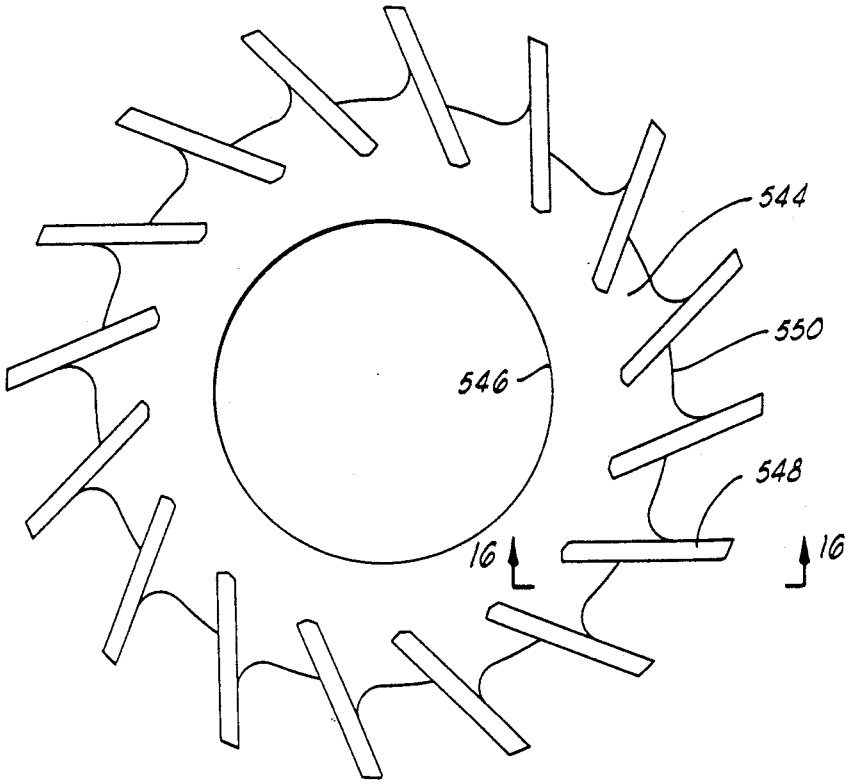
FIG. 14
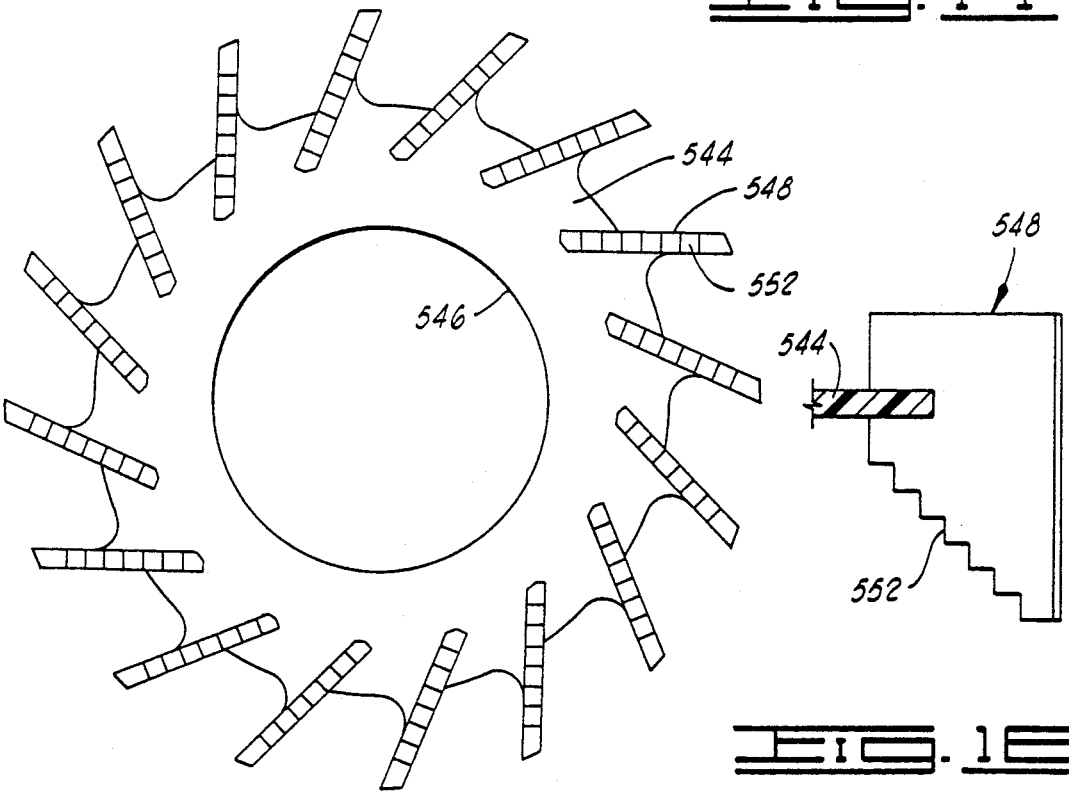
FIG. 16
FIG. 15

AUTOMATICALLY ADJUSTABLE FLUID DISTRIBUTOR

This application is a continuation-in-part of my pending application Ser. No. 07/714,848 for FLUID DISTRIBUTOR, filed Jun. 13, 1991.

BACKGROUND OF THE INVENTION

1. Field Of The Invention

The present invention relates generally to apparatus for distributing water and other fluids, and more particularly, but not by way of limitation, to a water distributor for use in a cooling tower.

2. Description Of The Prior Art

Typical prior art cooling towers utilize a grid work of overhead sprinklers much like a typical building fire sprinkler system. The grid work of sprinklers develops a plurality of overlapping circular spray patterns for the purpose of distributing water over the upper surface of a layer of fill material through which air is drawn. The water flows downward through the fill material as the air flows upward through or across the fill material, and thus heat is transferred from the water to the air.

It is important to obtain as uniform a distribution as possible of the water over the upper surface of the fill material so that the water will uniformly flow through the fill material across the entire cross-sectional area of the tower. If the water distribution is not uniform, channels will develop which are substantially void of water and which thus provide a low pressure path through which the air will channel thus greatly reducing the efficiency of the heat exchange operation conducted by the cooling tower.

Conventional grid work overhead sprinkler systems utilize a plurality of sprinklers which each have circular spray patterns. By its very nature, these systems tend to have areas of greater concentration and areas of lesser concentration of water distribution across the upper surface of the fill material thus leading to the inefficiencies described. Furthermore, the only way these sprinklers can be adjusted is by replacement of the orifices with different size orifices.

Furthermore, conventional overhead sprinkler systems have relatively small openings in the sprinkler heads which are prone to clogging by debris and corrosive buildup which is a natural result of handling the rather dirty water typically encountered in industrial cooling situations. As the sprinklers clog, further irregularities are created in the water distribution pattern thus further decreasing the efficiency of the cooling tower.

There is a need, particularly in the cooling tower industry, for a water distribution system which alleviates the problems mentioned above. There is a need for a distribution system which uniformly distributes water over the upper surface of the fill. There is a need for a clog-free distribution system. There is a need for a corrosion-resistant distribution system. There is a need for a distribution system having an adjustable nozzle. Furthermore, anything which can increase the efficiency of the tower greatly aids the economic viability of the tower since increased efficiency can lead to reduced size which can lead to reduced power consumption for exhaust fans and for hydraulic pumping.

SUMMARY OF THE INVENTION

The present invention provides an improved fluid distributing apparatus. The apparatus is particularly suited for use in a cooling tower wherein it can provide many improvements in efficiency and cost reduction for the tower. The apparatus is further applicable to many other fluid distribution systems including lawn sprinklers, pond aeration, moving of fluidized solids such as grain, and the like.

In one embodiment the fluid distributing apparatus has first and second annular surfaces spaced apart to define an annular nozzle opening therebetween. The first annular surface is an irregular surface shaped so that a spacing between the first and second annular surfaces varies around a circumference of the annular nozzle opening to create a non-circular spray pattern of fluid exiting the nozzle opening. The non-circular spray pattern is preferably a generally square pattern.

In another embodiment of the invention an automatic adjusting means is provided for increasing the spacing between the first and second annular surfaces in response to an increase in fluid pressure in the annular nozzle opening. A sliding connector means is provided for connecting the first and second structures while allowing relative sliding motion therebetween in a direction parallel to a central axis of the annular surfaces defined upon the first and second structures. A resilient biasing means, preferably a mechanical compression spring, is provided for resiliently opposing sliding motion of the first structure away from the second structure.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIG. 14 is a plan view of the slinger plate of the apparatus of FIG. 11.

FIG. 15 is a bottom view of the slinger plate of FIG. 14.

FIG. 16 is an enlarged elevation view taken along lines 16—16 of FIG. 14 showing a profile of one of the impeller blades.

DETAILED DESCRIPTION OF THE PREFERRED EMBODIMENTS

Figure 1:
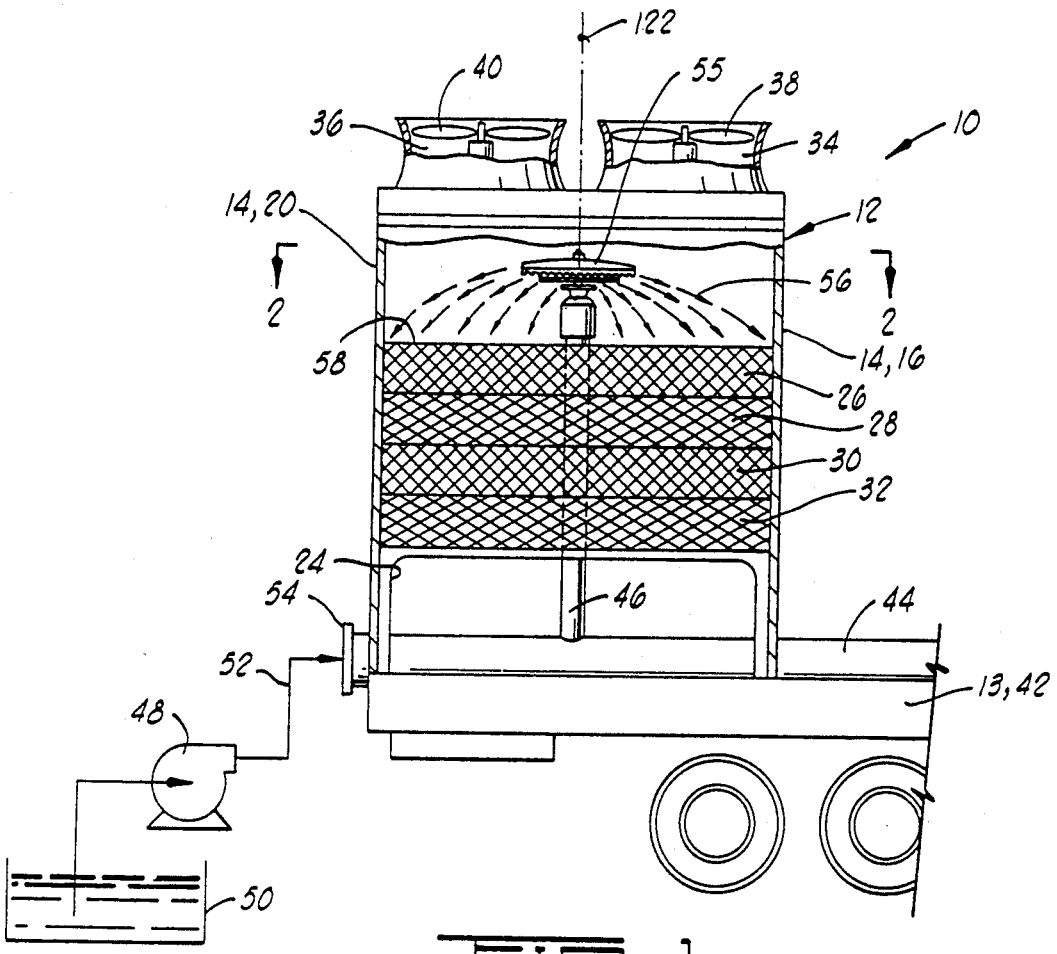
FIG. 1 is an elevation partly sectioned somewhat schematic view of a portable cooling tower incorporating the fluid distributing apparatus of the present invention.
Figure 8:
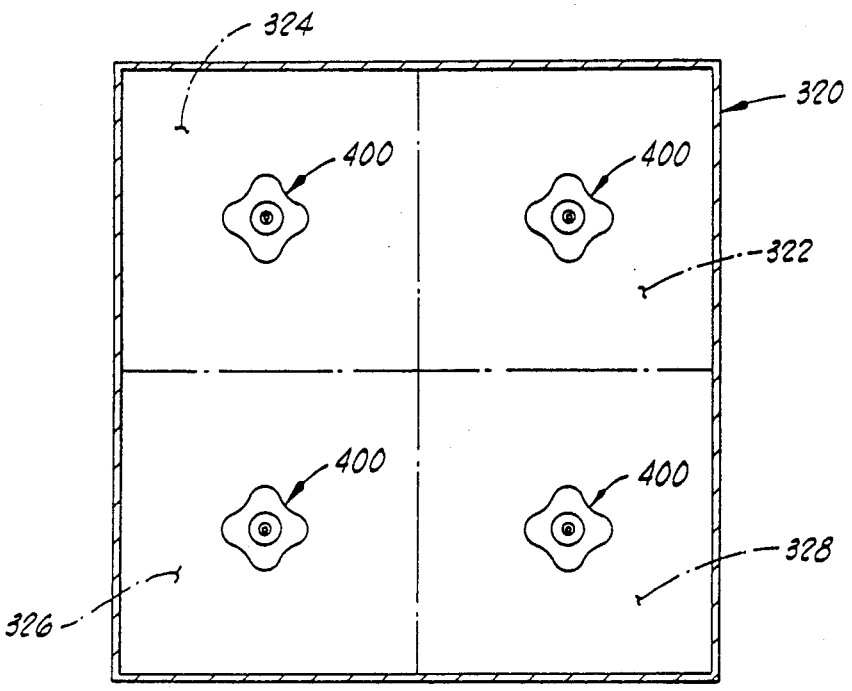
FIG. 8 is a schematic plan view similar to FIG. 2 of a larger cooling tower substantially square in shape and having four of the water distribution apparatus located in respective quadrants thereof to effect substantially uniform coverage over the entire area of the cooling tower.

Referring now to the drawings, and particularly to FIG. 1, a portable cooling tower apparatus is shown and generally designated by the numeral 10. Further details of construction of such a portable cooling tower are shown in U.S. Pat. Nos. 4,267,130 and 4,301,097 both to Curtis, which are incorporated herein by reference. The present invention is disclosed in the context of a portable cooling tower only by way of example. It will be understood that the water distributing apparatus of the present invention can of course be used in fixed cooling towers such as seen in FIG. 8, and further that it can be used in any fluid distributing application including for example lawn sprinklers, pond aeration, and even for moving fluidized solids such as grain.

The portable cooling tower 10 typically includes multiple cells each approximately eight feet square in plan view aligned on a trailer framework 13 as is more fully disclosed in the Curtis patents cited above. In FIG. 1 only a single cell 12 of the portable cooling tower apparatus 10 is shown.

The cooling tower 12 includes a cooling tower frame 14 having first, second, third and fourth sides 16, 18, 20 and 22, respectively. The four sides 16–22 define a rectangular, and in this example a square, framework as best seen in the plan view of FIG. 2. Each of the sides include air inlet openings 24 such as best seen in FIG. 1 in the lower portion thereof for allowing air to be drawn through the side walls 16–22.

Four layers of corrugated fill material 26, 28, 30 and 32 are shown within the framework 14. The corrugated fill material is a commonly used type of fill typically available in one foot cubes.

The upper end of the framework 14 carries shrouds 34 and 36 within which are located exhaust fans 38 and 40, respectively.

A collecting basin 42 is located on the trailer 13 below the cooling tower cell 12. A main horizontal pipe header 44 runs the length of the trailer 13. A vertical pipe header 46 extends upwardly from horizontal header 44 centrally within the cell 12. Vertical header 46 extends upward through the layers of fill material 26–32.

A pump 48 pumps water from a source 50 through a supply line 52 to the inlet 54 of horizontal header 44. The water flows up through vertical header 46 and is sprayed outward by a water distributing apparatus 55 as generally indicated by the arrows 56 in FIG. 1 to distribute the water uniformly across an upper surface 58 of the uppermost layer 26 of fill material. The exhaust fans 38 and 40 pull air in through the air inlets 24 and up through the layers of fill material 32, 30, 28 and 26 in counterflow to the downwardly flowing water. This cools the water which is then collected in the basin 42 and recirculated or otherwise used as desired.

Figure 3:
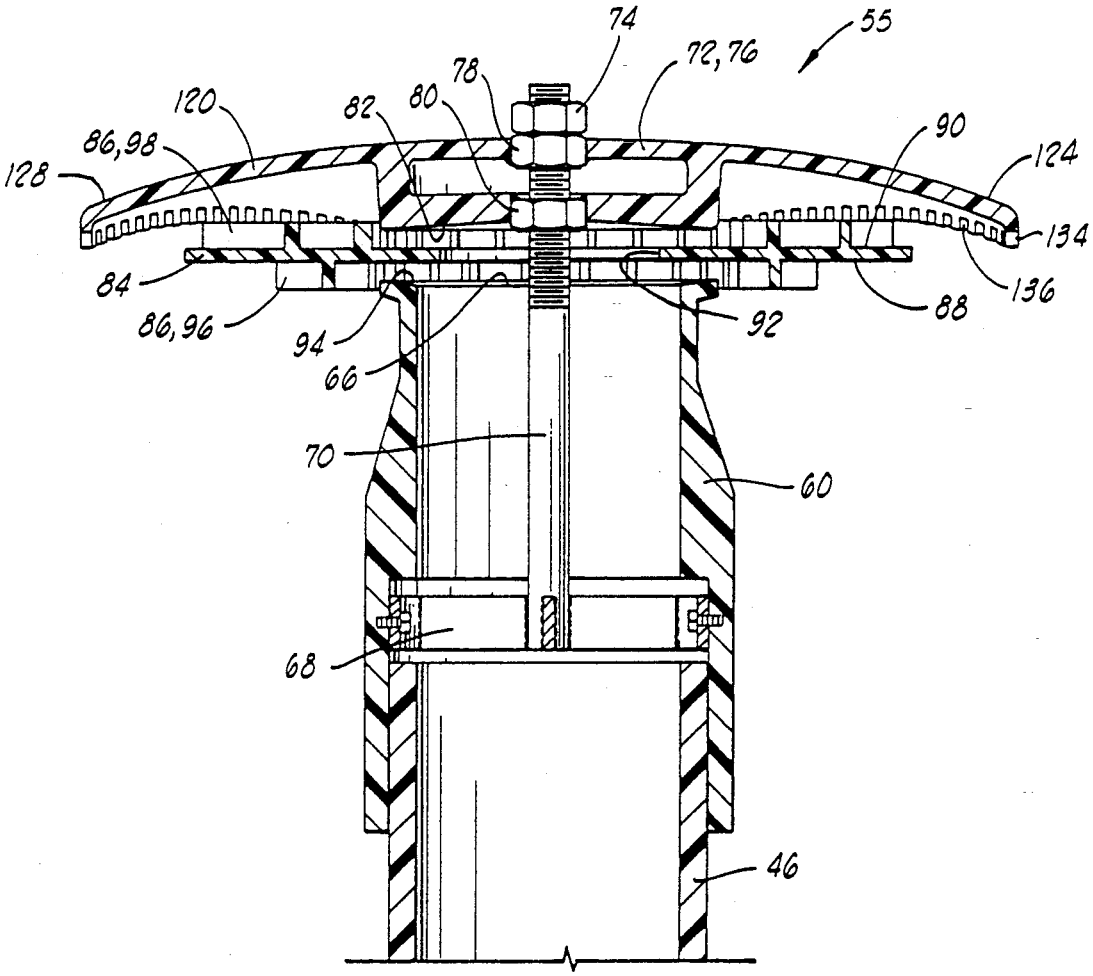
FIG. 3 is an elevation sectioned view taken along line 3—3 of FIG. 2 showing the internal details of the fluid distributing apparatus.

The details of construction of water distributing apparatus 55 are best seen in FIG. 3. The apparatus 55 includes a supply header 60 which is mounted on the upper end of the vertical pipe header 46. A fluid outlet 66 is defined in supply header 60.

A spider assembly 68 is rigidly attached internally within the header 60 and a threaded support rod 70 is fixed to spider 68 and extends upwardly through fluid outlet 66.

An upper limiting and shrouding structure 72 is adjustably threadedly mounted upon threaded rod 70 and held in place relative thereto by a lock nut 74.

The structure 72 has a central hub portion 76 which has two threaded nuts 78 and 80 imbedded therein which threadedly receive the rod 70.

Structure 72 has an upper limit surface 82 defined thereon which is spaced from the fluid outlet 66 of header 60.

A rotatable slinger plate 84 is located between the fluid outlet 66 and the upper limit surface 82. Slinger plate 84 may also be referred to as a rotating deflector plate 84 or a flow divider plate 84. Further, it is noted that the term plate is used in a broad sense and is not limited to flat plates having planar surfaces. The plate could be somewhat irregularly shaped.

Impeller means 86 are connected to the slinger plate 84 for rotating the slinger plate 84 as fluid flows through the fluid outlet 66 past the impeller means 86.

The slinger plate 84 has first and second sides 88 and 90, respectively, which may also be referred to as lower and upper sides 88 and 90, respectively. The first and second sides 88 and 90 face the fluid outlet 66 and the upper limit surface 82, respectively.

The slinger plate 84 has a central opening 92 defined therethrough which is aligned with the fluid outlet 66.

The header 60 has a lower limit surface 94 defined thereon surrounding the fluid outlet 66.

Fluid flowing upwardly through the header 60 and up out the fluid outlet 66 splits into first and second streams. A first stream can be described as an annular first stream which flows radially outward between the lower first side 88 of slinger plate 84 and the upward facing lower limit surface 94 surrounding fluid outlet 66. The second stream flows upward through central opening 92 and then spreads into a radially outwardly flowing annular second stream which flows between the second upper surface 90 of limit plate 84 and the downwardly facing upward limit surface 82.

The size of the opening 92 in slinger plate 84 relative to the size of fluid outlet 66 affects the proportion of the water which will flow over the top of slinger plate 84 as compared to that portion which flows across the bottom of slinger plate 84.

Figure 4:
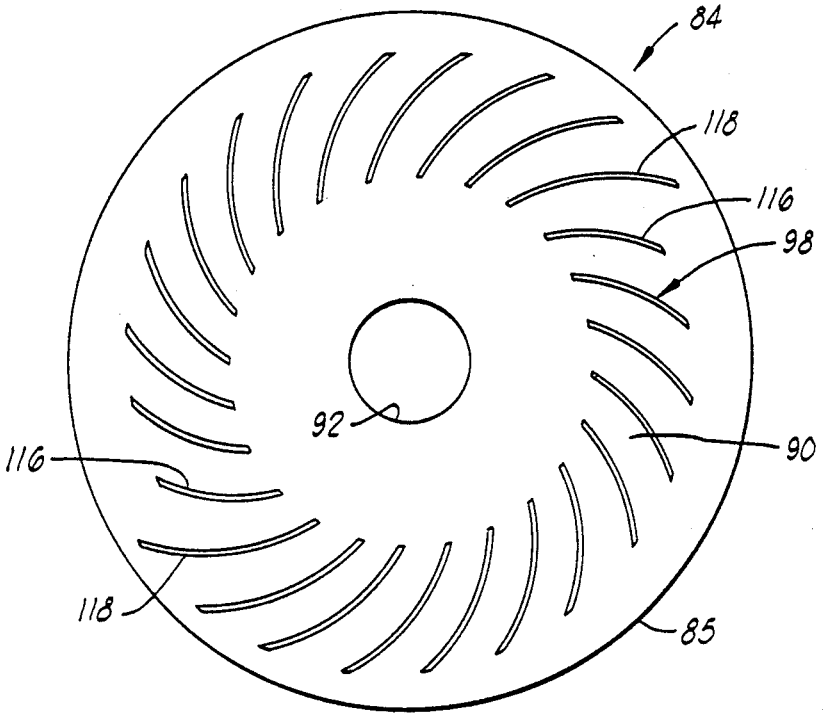
FIG. 4 is a top plan view of the slinger plate showing the arrangement of the impeller blades thereon.
Figure 5:
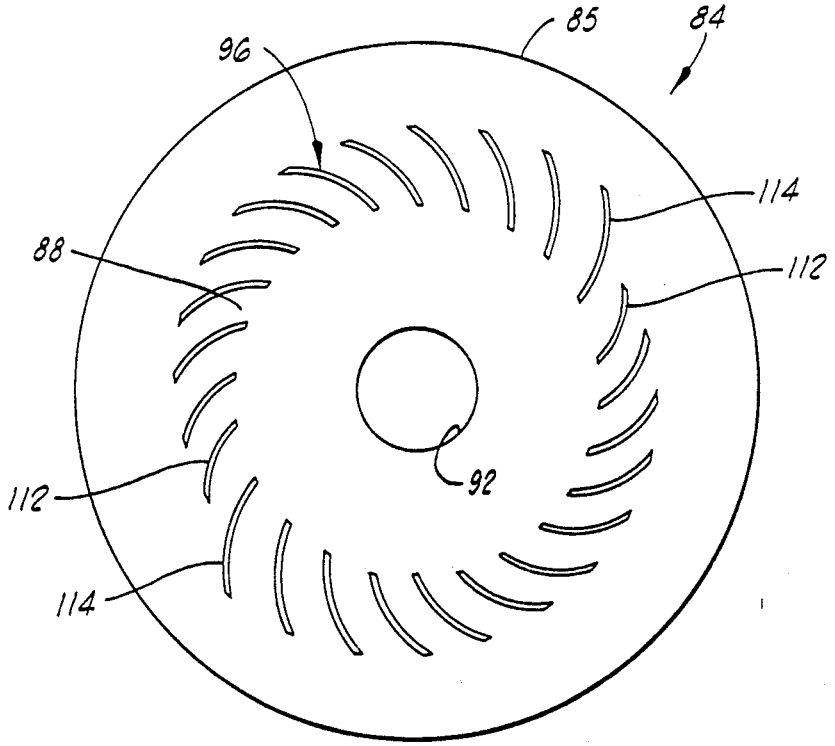
FIG. 5 is a bottom view of the slinger plate of FIG. 4.

The impeller means 86 includes first and second sets 96 and 98, respectively, of impeller blades attached to the lower and upper surfaces, respectively, of the slinger plate 84. The first set of impeller blades 96 is best seen in FIG. 5, and the second set of impeller blades 98 is best seen in FIG. 4. As the two streams of fluid flow radially outward across the lower surface 88 and the upper surface 90 of slinger plate 84, the fluid is deflected by the impeller blades 96 and 98 and causes the impeller blades and the slinger plate 84 to rotate. The slinger plate 84 rotates within these two sheet-like radially outward flowing streams which define a fluid bearing means for allowing the slinger plate 84 to rotate free of contact with the header 60 and the limit structure 72.

The adjustable positioning of structure 72 upon the threaded rod 70 provides an adjustment means for adjusting a distance between the upper and lower limit surfaces 82 and 94 thus adjusting the vertical clearance between the slinger plate 84 and each of the limit surfaces 82 and 94. It will be understood that as this clearance is reduced, the area for fluid flow therethrough is reduced thus increasing the back pressure on the fluid flowing upwardly through header 60 and causing a radially outward extending spray pattern defined by distributor 55 to be varied.

This adjustable orifice is a significant advantage as compared to conventional grid type sprinkler systems (see FIG. 9) used in water cooling towers which all have fixed orifices. The water pressure typically supplied to a cooling tower may be as low as 1 to 3 psi. The prior art nozzle sizes are chosen for a design supply pressure, but if the pressure is reduced the system will work very poorly because the nozzles cannot develop an adequately sized spray pattern. The only solution to reduced pressure with prior art nozzles is to replace the nozzles with other nozzles having a smaller orifice size. The adjustable nozzle of the present invention improves this situation in two ways.

First, it can be adjusted as necessary to accommodate supply pressure changes.

Second, the fluid distributor of the present invention is much less sensitive to varying pressure because the rotating plate 84 greatly aids in radial distribution of the water even at relatively low pressures. One prototype constructed similar to that shown in FIGS. 1-3 was tested over a range of supply pressures varying from about 1 psi to about 12 psi in an 8 ft. by 8 ft. cell. The radius of the spray pattern which was nominally 4 ft. at higher pressures dropped by no more than about 6 inches when supply pressure was dropped to about 1 psi. Thus, the maximum radius of the spray pattern varied approximately 12.5%. Very conservatively it can be said that the spray pattern has a maximum radius which varies no more than 25% over a range of fluid pressure supplied to the nozzle of from about 1 psi to about 12 psi.

This fluid distributor can also be described as a nozzle means for distributing liquid in a spray pattern having a radius of at least three feet at liquid supply pressure as low as 1 psi. Thus a single nozzle of the present invention can be used to replace a great many conventional nozzles like those of FIG. 9 which typically have a spray pattern with a radius of no greater than about eighteen inches.

The limit surface 82 can be characterized as an outer limit surface 82 for limiting movement of the slinger plate 84 away from the fluid outlet 66. It will be appreciated, however, that once the apparatus 55 is in operation and the rotating slinger plate 84 has settled into a steady state, it will not actually engage either the header 60 or the structure 72. It will "float" on a water bearing defined by the two sheet-like radially outward flowing annular streams as illustrated in FIG. 3.

In the embodiment shown in FIG. 3, the lower and upper surfaces 88 and 90 of slinger plate 84 are flat, whereas the lower and upper limit surfaces 94 and 82 are somewhat concave so that the sides 88 and 90 of limit plate 84 do not conform to the limit surfaces 94 and 82, respectively. The purpose of this is to make certain that the two radially outward flowing streams can establish themselves so that the slinger plate 84 will "float" between the limit surfaces 94 and 82 when in operation. The clearances between sides 88 and 90 and surfaces 94 and 82, respectively, in effect define two nozzles both of which are adjusted when the clearance between structure 72 and header 60 is adjusted.

Prior to beginning operation of the apparatus 55, the slinger plate 84 will be resting against the header 60. Due to the concave shape of the lower limit surface 94, however, there will be a short vertical clearance or gap between limit surface 94 and the bottom surface 88 of slinger plate 84 adjacent the fluid outlet 66 thus insuring that the high pressure fluid exiting outlet 66 will find its way between the slinger plate 84 and the lower limit surface 94 thus establishing the first radially outward fluid stream.

Similarly, even if the slinger plate 84 temporarily engages the upper structure 72 when the water is first turned on, the concave shape of upper limit surface 82 insures that there will be a vertical clearance or gap between upper limit surface 82 and the upper surface 90 of slinger plate 84 adjacent the central opening 92 through slinger plate 84 so that the second radially outward flowing stream can establish itself above the slinger plate 84.

Figure 2:
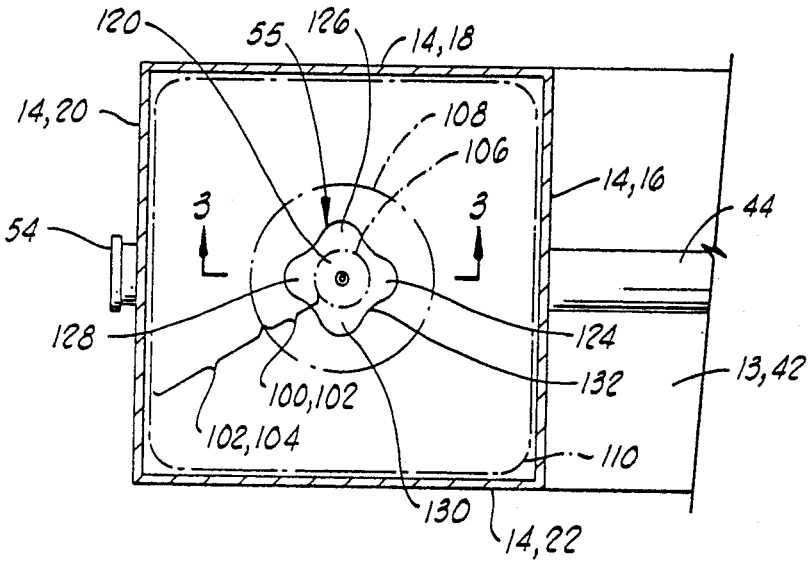
FIG. 2 is a sectioned plan view taken along line 2—2 of FIG. 1.

As seen in FIGS. 4 and 5, the first and second sets of impeller blades 96 and 98 are not identically constructed. The lower or first set of impeller blades 96 is in fact constructed to deflect the first radially outward flowing stream of fluid so that it will fall generally within a radially inner portion 100 of a spray pattern 102 as schematically represented in FIG. 2. The upper set of impeller blades 98 is constructed so that it will deflect the second radially outward flowing stream of fluid generally over a radially outer portion 104 of the spray pattern 102. The inner and outer portions 100 and 104 of spray pattern 102 are schematically represented in FIG. 2 in phantom lines.

The radially inner portion 100 of spray pattern 102 extends generally from an inner perimeter 106 to an intermediate radius 108. The outer portion 104 of spray pattern 102 extends generally from intermediate radius 108 to outer perimeter 110. It will be understood that there can of course be some overlap of the inner and outer portions 100 and 104 in the vicinity of the intermediate radius 108. The water distributing apparatus 55 sprays the water in the spray pattern 102 extending 360° about a central longitudinal axis 122 of the vertical header pipe 46.

This is accomplished by appropriate choice of the shape, size and placement of the impeller blades.

For example, the bottom set of impeller blades 96 is made up of a pattern of blades beginning with a shortest bottom blade 112 and increasing in size to a longest bottom blade 114. This pattern repeats over a 180° circumference of the bottom surface 88 of plate 84 as seen in FIG. 5. Similarly, the upper set of blades 98 seen in FIG. 4 includes a repeating pattern which begins with a shortest top blade 116 and increases to a longest top blade 118.

Preferably, the longest bottom blade 114 is no longer than the shortest top blade 116.

The upper limit and shroud structure 72 includes an umbrella-shaped shroud 120 (see FIG. 3) which extends radially outward over the slinger plate 84 and downward toward the slinger plate 84. The purpose of the shroud 120 is to deflect the fluid flowing past the slinger plate 84 into a non-circular pattern. Preferably, as best seen in FIG. 2, the shroud 120 deflects the fluid into a generally rectangular pattern corresponding to the outer perimeter 110 which generally corresponds to the size and shape of the cooling tower framework 14 as defined by the four sides 16–22. This generally rectangular pattern is generally square in the embodiment illustrated. A square pattern is of course one type of generally rectangular pattern.

As best seen in FIG. 2, the shroud-shaped deflector means 120 has a cloverleaf shape with four radially protruding leaves 124, 126, 128 and 130 corresponding to the four sides of the generally rectangular spray pattern defined by generally rectangular outer perimeter 110. Each of the leaves 124–130 extends radially outward and down toward the slinger plate 84 further than intermediate portions of the shroud such as intermediate portion 132. Thus, the spray pattern is deflected downwardly more at those positions adjacent the leaves 124–130 thus bringing in the outer perimeter into the generally rectangular shape 110. As seen in FIG. 2, the fluid distributing apparatus is centrally located within the cooling tower cell 12.

As best seen in FIG. 3, the outer edge of shroud 120 includes a downwardly turned lip 134 having a plurality of notches 136 cut therein. The purpose of lip 134 is again to aid in knocking down the spray pattern, and the notches 136 still prevent undue interference with the spray pattern.

The impeller blades 96 and 98 of varying length cause water to be deflected to varying radial positions across the spray pattern 102. Since the impeller blades 96 and 98 also cause the slinger plate 84 to rotate, this causes the water flowing outward along any given radius from the central axis 122 to pulsate radially outward, then back inward, then back outward, etc. This pulsating flow causes the water to be relatively substantially uniformly distributed between the inner perimeter 106 and outer perimeter 110 of the spray pattern 102 across the entire upper surface 58 of the upper layer 26 of fill material.

The upper and lower limit surfaces 82 and 94, and the upper and lower surfaces 90 and 88 of slinger plate 84, effectively define a nozzle means for spraying fluid radially outward 360° about the fluid outlet 66. This nozzle means can be adjusted by adjusting the position of the structure 72 which is fixed in place in a selected position by lock nut 74.

The slinger plate 84 can also be more generally described as a flow divider plate 84 which is located between and freely movable between the upper and lower limit surfaces 82 and 94. The flow divider plate 84 as previously described splits a stream of fluid flowing out fluid outlet 66 into first and second streams flowing under and over the divider plate 84.

The impeller means 86 including the first and second sets of impeller blades 96 and 98 can be generally described as a first rotating deflector means 86 for deflecting fluid flowing out the nozzle means so that the fluid is substantially uniformly radially distributed between the inner perimeter 106 and outer perimeter 110 of spray pattern 102. In fact, the first and second sets of impeller blades 96 and 98 can be generally described as first and second rotating deflector means 96 and 98, one of which deflects the first annular fluid stream to generally cover the radially inner portion 100 of spray pattern 102, and the other of which deflects the other of the annular streams to generally cover the radially outer portion 104 of spray pattern 102.

The shroud structure 120 can be generally described as a fixed deflector means 120 for deflecting the fluid flowing out the nozzle means so that the outer perimeter 110 of the spray pattern 102 is non-circular. This deflector means 120 is fixed relative to the header 60 during the operation of the fluid distributing apparatus 55 by attachment to support rod 70. Other means of fixing structure 72 and shroud 120 to header 60 could include support arms (not shown) located around the periphery of the shroud 120 and attached to header 60.

By way of example, one embodiment of the apparatus 55 has a diameter of outlet 66 of four inches, and a diameter of opening 92 in slinger plate 84 of three inches. That device is constructed for flow rates in the range of from about 300 to 400 GPM at a pressure drop of 3 to 5 psi.

Figure 6:
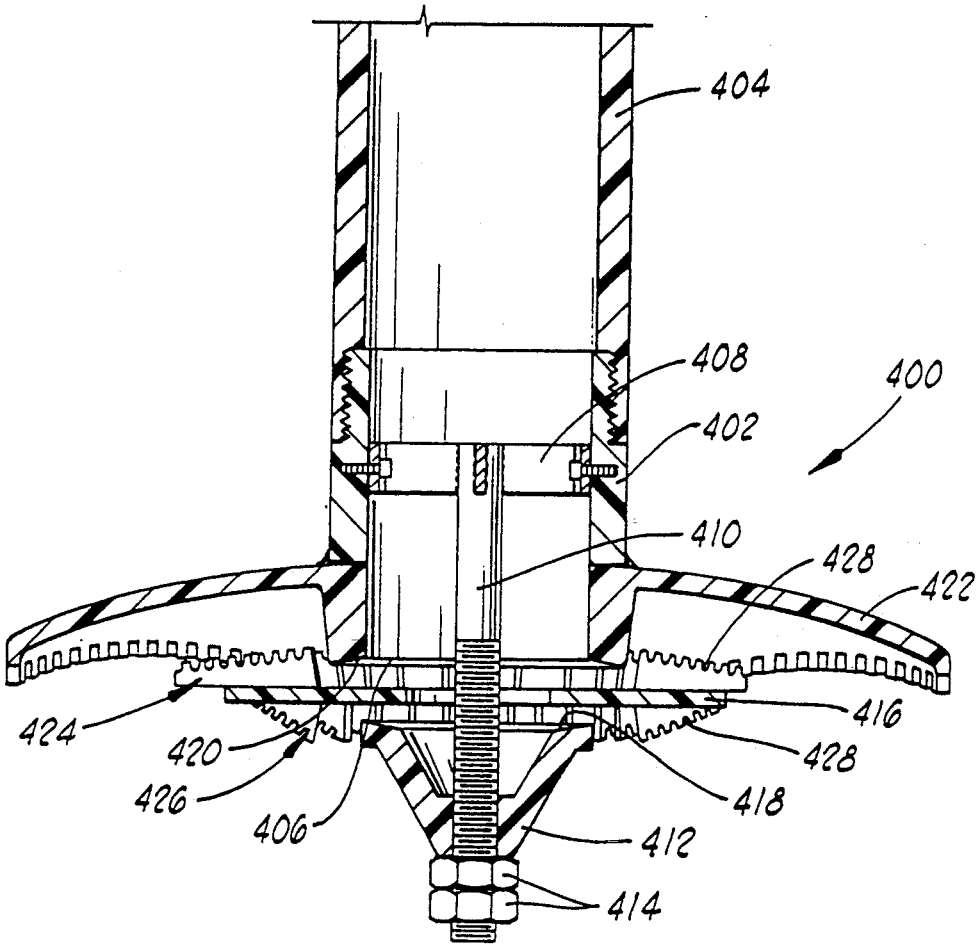
FIG. 6 is an elevation sectioned view of an alternative embodiment of the invention constructed for use with a downwardly facing fluid outlet.

The Alternative Embodiment Of FIG. 6

The fluid distributing apparatus 55 can also be modified to operate in an inverted position so that it distributes water from a downwardly open fluid outlet as illustrated in FIG. 6.

The fluid distributing apparatus shown in FIG. 6 is generally designated by the numeral 400. It includes a supply header 402 connected to a vertical pipe header 404. A downwardly facing fluid outlet 406 is defined in supply header 402.

A spider assembly 408 is attached to header 402 and a downwardly extending support rod 410 extends therefrom.

A limit structure 412 is threadedly attached to support rod 410 and its position is fixed relative thereto by lock nuts 414.

A slinger plate 416 is located between outlet 406 and support structure 412. A lower annular limit surface 418 is defined on limit structure 412. An upper annular limit surface 420 is defined on supply header 402 adjacent outlet 406.

A shroud 422 having a shape substantially like that of the shroud 120 described with regard to the apparatus 55 is integrally constructed with and extends radially outward and downward from the header 402.

The slinger plate 416 has a plurality of upper impeller blades 424 attached to its upper surface, and has a plurality of lower impeller blades 426 attached to its lower surface. The impeller blades 424 and 426 of the apparatus 400 are slightly modified as compared to those of the apparatus 55 in that the impeller blades have notches 428 cut in their periphery to reduce the interference with fluid flow while still providing an impeller that will rotate the slinger plate 416 and will adequately deflect the water to the desired radial location.

In the view of FIG. 6, the slinger plate 416 is again shown "floating" between the upper and lower limit surfaces 420 and 418, respectively, as it would when in operation with water flowing above and below the slinger plate 416.

The apparatus 400 will generate a generally rectangular spray pattern just like the pattern 102 described with regard to FIG. 2. The use of downwardly directed fluid distributing apparatus 400 will generally be desirable in a cooling tower which is sufficiently large as to require multiple distributors, such as for example in a situation like that shown in FIG. 8.

When multiple distributors are utilized, it will generally be accomplished through the use of some horizontal pipe headers supplying fluid to each distributor, and it is preferred that those horizontal headers be located above the spray pattern rather than below so as not to interfere with the downwardly dropping spray pattern.

FIG. 6 also illustrates another aspect of the invention, namely that the two annular surfaces 418 and 420 can be of different diameters. In the apparatus 400 it is preferred that the lower surface 418 be as small as possible so as to minimize or eliminate any void in the spray pattern immediately below the apparatus 400.

The two surfaces 418 and 420 and the plate 416 located therebetween can be described as defining a dual nozzle means including a first annular nozzle outlet defined between plate 416 and the upper annular surface 420, and a second annular nozzle outlet defined between the plate 416 and the lower annular surface 418. Thus these two nozzle outlets or nozzles may be of different diameters to create the desired spray pattern.

Figure 7:
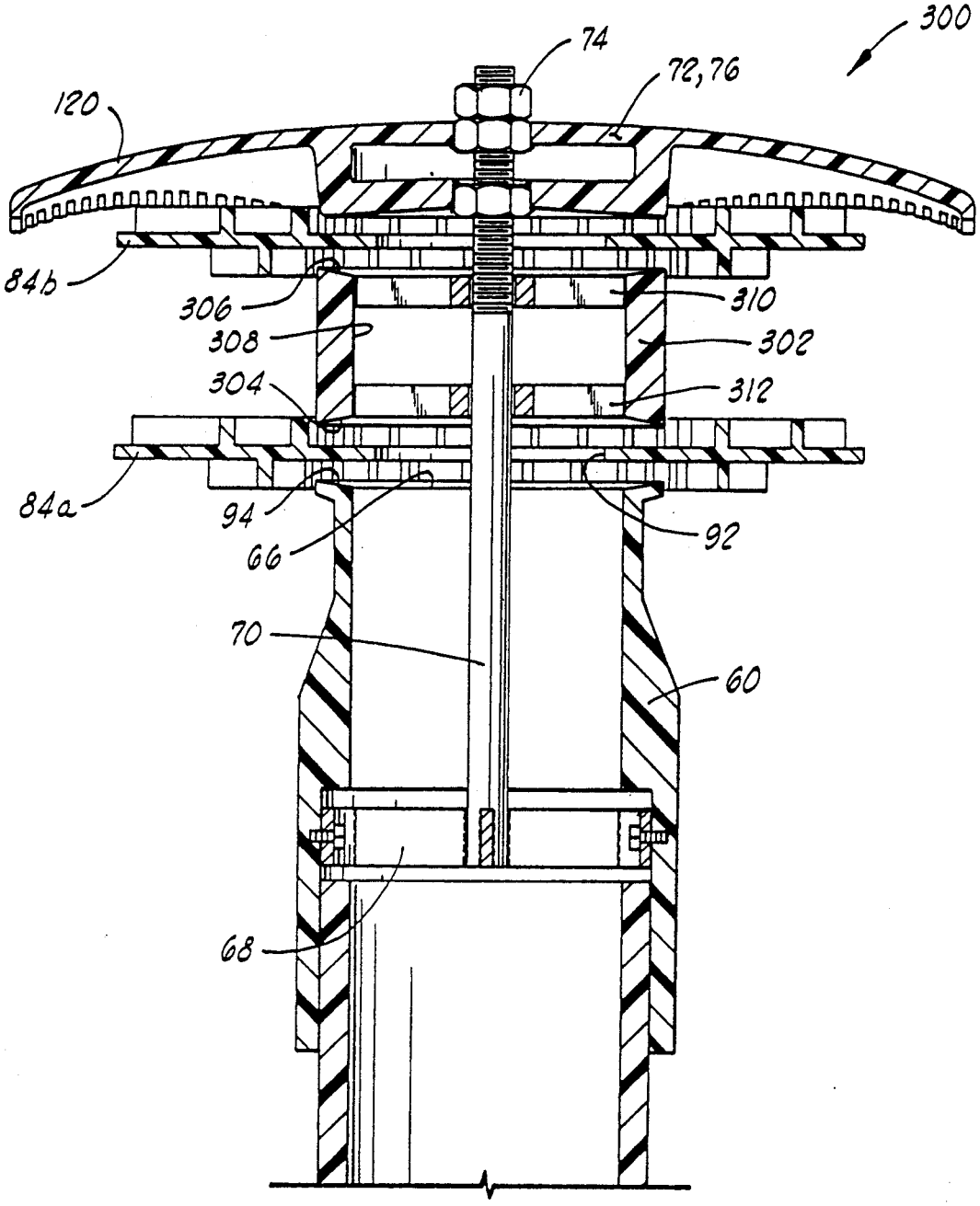
FIG. 7 is an elevation sectioned view of another alternative embodiment of the present invention similar to FIG. 3 with the addition of a second slinger plate.

The Alternative Embodiment Of FIG. 7

FIG. 7 illustrates a modified version of the apparatus of FIG. 3 including multiple slinger plates 84*a* and 84*b*. The apparatus of FIG. 7 is shown and generally designated by the numeral 300.

The threaded support rod 70 has been lengthened, and a second slinger plate 84*b* has been added with a spacer hub 302 being slidably centrally located on rod 70 between the two slinger plates 84*a* and 84*b*.

Spacer hub 302 has a downwardly facing limit surface 304 defined on the lower end thereof, and has an upwardly facing limit surface 306 defined on the upper end thereof which function in the same manner as previously described for the other limit surfaces. A central flow passage 308 communicates lower and upper surfaces 304 and 306. Spider supports 310 and 312 allow spacer hub 302 to freely slide on support rod 70.

Thus, with the apparatus 300 of FIG. 7, the fluid flowing upwardly out fluid outlet 66 will split into four radially outwardly flowing annular streams. The first stream will flow across the bottom surface of the lower slinger plate 84*a*. The second stream will flow across the upper surface of the lowermost slinger plate 84*a*. The third stream will flow across the lower surface of the uppermost slinger plate 84*b*. Finally, the fourth stream will flow across the upper surface of the upper slinger 84*b*. The shroud 120 will deflect a portion of the fourth stream of fluid flowing across the upper surface of the upper slinger plate 84*b* thus deflecting it into the desired non-circular spray pattern.

It will be appreciated that the impeller blades on each of the lower and upper slinger plates 84*a* and 84*b* can be configured so as to deflect water over a desired radial portion of the spray distribution pattern. With appropriate sizing, shaping and arrangement of the deflector blades, four generally concentric portions of the radial distribution pattern can be covered by the four streams just described.

Due to the greater fluid pressure which will be required to operate a multiple slinger plate apparatus 300, it is anticipated that the apparatus 300 will be more useful in situations such as pond aeration or the like. Typical cooling tower installations only have 3 to 5 psi available and will preferably use either apparatus 55 or apparatus 400.

The Embodiment Of FIG. 8

FIG. 8 schematically illustrates the application of the fluid distributing apparatus 55 of the present invention to a larger cooling tower defined by a framework 320. Phantom lines in FIG. 8 indicate four quadrants 322, 324, 326 and 328 within the framework 23. One of the spray distributing apparatus 400 like that of FIG. 6 is located within each of the quadrants so as to cover it in substantially the same manner as illustrated in FIG. 2.

Figure 10:
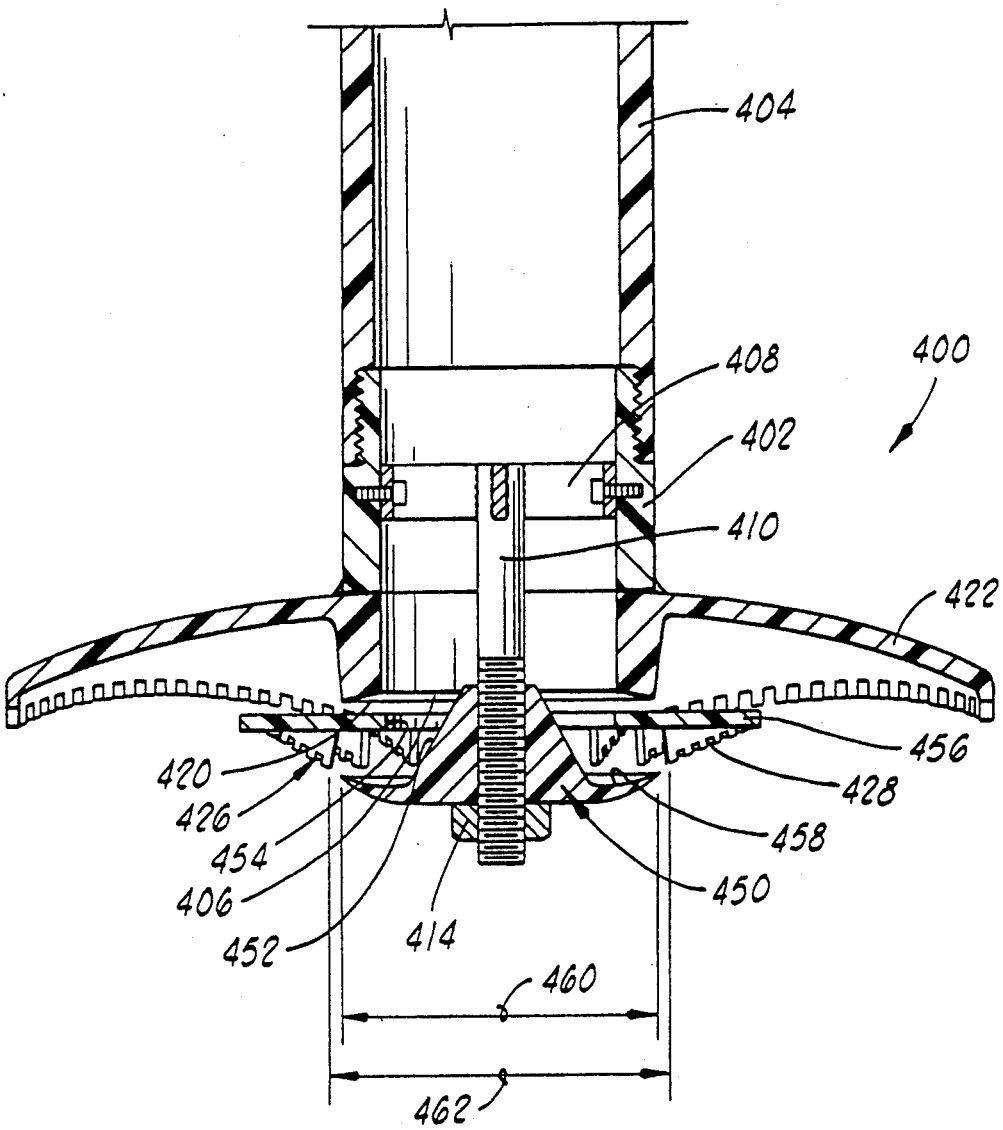
FIG. 10 is an elevation sectioned view similar to FIG. 6 of an alternative embodiment which has impeller blades on only one side of the rotating disc.

The Embodiment Of FIG. 10

FIG. 10 illustrates another embodiment similar to that of FIG. 6. The modifications as compared to FIG. 6 reside primarily in the elimination of the upper deflector blades 424 and the change in shape of the lower limit structure.

The lower limit structure 450 has a conical hub 452 which passes through the central opening 454 of slinger plate 456. Hub 452 is threadedly received on shaft 410 and held in place by lock nut 414.

An upward facing lower limit surface 458 is defined on limit structure 450, and has an outer diameter 460 less than an inside diametrical clearance 462 of the lower deflector blades 426. This prevents interference between limit structure 450 and deflector blades 426.

The slinger plate 456 is shown in FIG. 10 "floating" between limit surfaces 420 and 458 as it would in operation. The size of opening 454 and of conical hub 452 will affect the annular flow area defined therebetween which will affect the percentage of total flow which will flow across the bottom of plate 456 as compared to that which flows across the top of plate 456. Also the diameters of opening 406, the outside diameter of surface 420, the diameter of opening 454 and diameter 460 of limit structure 450 will affect the upwardly and downwardly directed fluid pressures acting on plate 456. All of those factors together will determine the vertical floating position of plate 456.

Experimentation with the shape and dimensions of the various components just mentioned, plus the deflector blades 426 and shroud 422 will affect the pattern of fluid distribution and will show the appropriate choices to achieve a desired fluid distribution in any particular situation. It has been determined that the elimination of the upper deflector blades as shown in FIG. 10, and as compared to FIG. 6, will cause the plate 456 to float relatively close to upper limit surface 420 and will reduce the relative amount of fluid going to the radially outer portions of the spray pattern.

The Embodiment Of FIGS. 11-16

Figure 11:
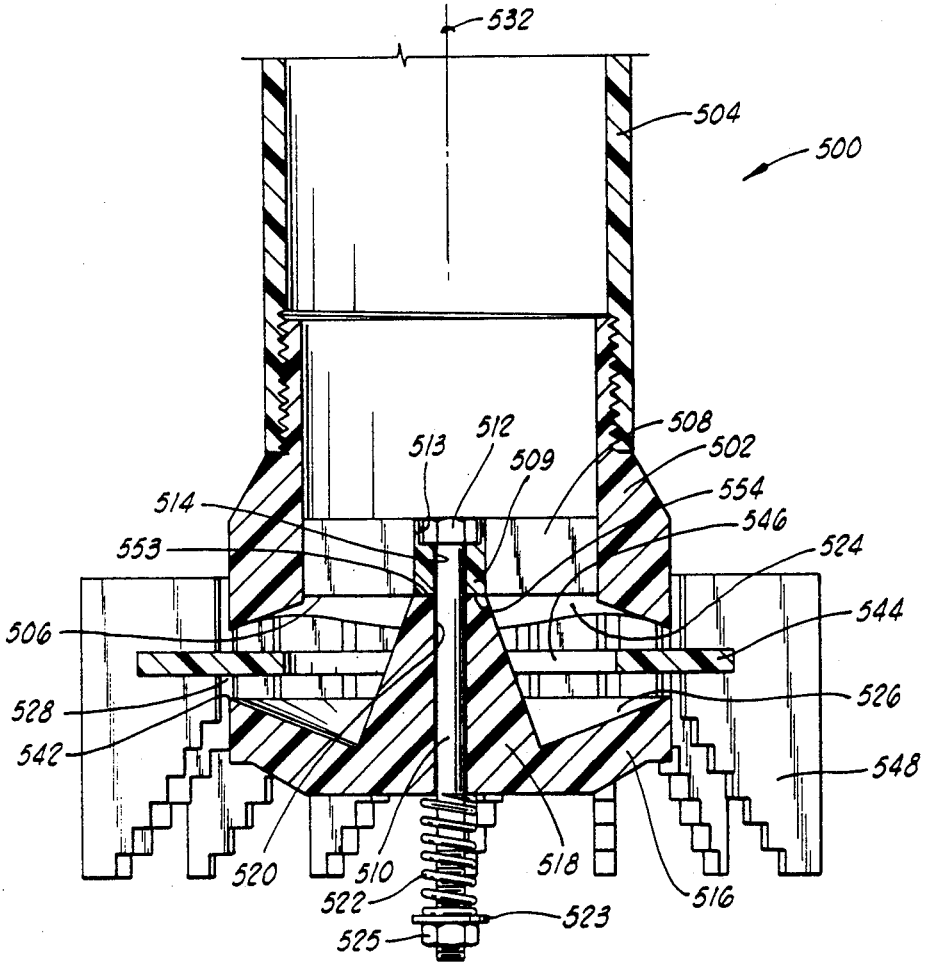
FIG. 11 is an elevation sectioned view similar to FIG. 6 of another alternative embodiment of the invention having an irregular shaped annular surface to define the generally square spray pattern.

FIG. 11 is an elevation sectioned view showing another embodiment of the invention which is generally designated by the numeral 500. The apparatus 500 includes a supply header 502 connected to a vertical pipe header 504. A downwardly facing fluid outlet 506 is defined in supply header 502.

A spider 508 is integrally molded with supply header 502 and has a central hub 509.

A downwardly extending support rod or bolt 510 has a hex head 512 at its upper end which is received in a hex socket 513 molded in hub 509. Bolt 510 extends downward through bore 514 of hub 509.

A limit structure 516 which can also be referred to as a deflector plate 516 has a hub 518 with a central bore 520 which slidably receives the support rod 510 therein.

A coil compression mechanical spring 522 is disposed about the support rod 510 on a side of the deflector plate 516 opposite the fluid outlet 506. It is held in place by a washer 523 and nut 525.

The supply header 502 has an irregular shaped first annular surface 524 defined thereon. The limit structure or deflector plate 516 has a second annular surface 526 defined thereon. The first and second annular surfaces 524 and 526 are spaced apart to define an annular nozzle opening 528 therebetween.

The first annular surface 524 is an irregular shaped surface shaped so that a vertical spacing between the first and second annular surfaces 524 and 526 varies around a circumference of said annular nozzle opening 528 to create a non-circular spray pattern of fluid exiting the nozzle opening 528.

Figure 12:
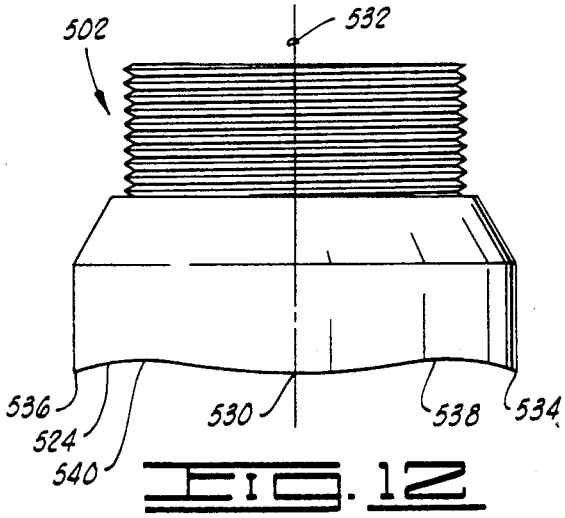
FIG. 12 is an elevation view of the header outlet of the apparatus of FIG. 11, showing the irregular annular surface in one profile with a peak of the surface centered in the figure.
Figure 13:
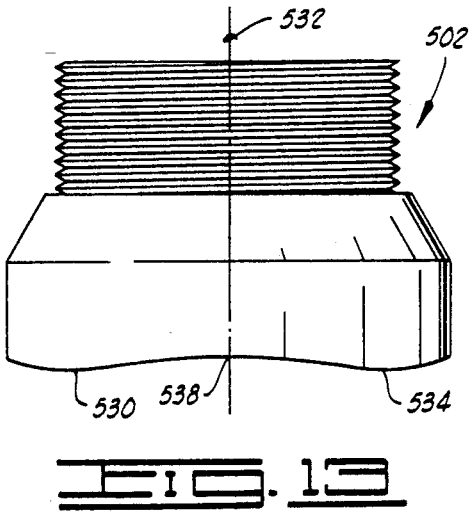
FIG. 13 is a view similar to FIG. 12, but rotated 45° about an axis of the header end piece so that a trough of the irregular surface is centered in the figure.

As is best illustrated in FIGS. 12 and 13, the irregular shaped first annular surface 524 is an undulating surface having four peaks equally spaced at 90° intervals about the circumference of annular surface 524, and having four troughs located between said peaks and also being substantially equally spaced. One of the troughs is located equidistant between each adjacent pair of peaks. In FIG. 12, one peak designated as 530 is oriented on a center line 532 of supply header 502. Two other peaks 534 and 536 lie on the left and right edges of the profile seen in FIG. 12. The fourth peak is hidden directly behind first peak 530. One trough located between peaks 530 and 534 is designated as 538. Another trough between peaks 530 and 536 is designated as 540.

In FIG. 13, the supply header 502 has been rotated 45° clockwise about its center line 532 so that now the trough 538 lies on center line 532. Peaks 534 and 530 are also visible.

As best seen in FIG. the irregular shaped first annular surface 524 also is inwardly and upwardly tapered toward the fluid outlet 506.

As is apparent in FIGS. 12 and 13, the undulations formed by the peaks and troughs are of uniform height, so that the annular nozzle opening 528 has four widest spots located between the troughs and the second annular surface 526, and four narrowest spots located between the peaks and second annular surface 526. Thus, a generally square spray pattern will be provided since substantially more fluid will flow through the more open portions of the annular opening 528. Thus, if a single nozzle apparatus 500 is utilized over a square fill area as generally shown in FIG. 2, the troughs will be oriented toward the corners of the square.

The second annular surface 526 is a uniform frustoconically shaped surface and can be described as having a radially outermost edge 542 which will lie substantially in a plane. It will be understood, however, that if desired both of the annular surfaces 524 and 526 could be irregular shaped so as to contribute to the variance in spacing therebetween. With the preferred embodiment illustrated, however, the spacing between the first and second annular surfaces 524 and 526 will be substantially equal at each of the troughs and at each of the peaks in the first surface 524.

A rotating slinger plate or flow divider plate 544 is located between the first and second annular surfaces 524 and 526 and functions in the same manner as previously described for the other embodiments. A circular central opening 546 is defined through the divider plate 544. The divider plate 544 is shown in FIG. 11 in a "floating" position as it would be during normal operation.

The impeller blades of the apparatus 500 have been modified somewhat as compared to the previously described embodiments. The apparatus 500 includes a plurality of impeller blades such as 548 attached to the plate 544 around the annular nozzle opening 528. Each of the blades 548 extends radially outward beyond an outer edge 550 (see FIG. 14) of plate 544. Each of the impeller blades 548 also extends both above and below the plate 544 to intercept fluid flowing outward both over and under the plate 544.

As best seen in the profile view of FIG. 16, each of the impeller blades 548 includes a radially inner serrated edge 552 for atomizing the fluid exiting the annular nozzle opening 528. Further, the significant extent to which the impeller blades 548 extend below the plate 544 in conjunction with the serrated edge 552 provides a means for deflecting some of the fluid exiting the annular nozzle opening 528 below the plate 544 back radially inward toward the longitudinal axis 532 of the annular nozzle opening 528 to eliminate a central void in the spray pattern below the nozzle opening 528 and particularly below the deflector plate 516.

Returning now to the slidable mounting of the deflector plate 516 upon support rod 510, that slidable mounting in combination with the compression spring 522 provides an automatic adjusting means for increasing the spacing between the first and second annular surfaces 524 and 526 in response to an increase in fluid pressure in the annular nozzle opening 528.

The apparatus 500 is initially assembled with an axially inner upper end 553 of deflector hub 518 held in abutting engagement with an axially outer or lower end 554 of spider hub 509. This is accomplished by running nut 525 up on threaded bolt 510 to compress spring 522 until spring 522 holds deflector hub 518 against spider hub 509.

It will be appreciated that when the fluid pressure supplied to the apparatus 500 is increased, that increased fluid pressure will create an increased downward force acting on deflector plate 516 which will cause the compression spring 522 to be compressed thus increasing the spacing between annular surfaces 524 and 526. The spring 522 can be generally described as a resilient biasing means 522 for resiliently opposing sliding motion of the deflector plate 516 downward away from the supply header 502. The spring rate of spring 522 can be adjusted by increasing or decreasing the initial compression applied by nut 525.

The deflector plate 516 is shown in FIG. 11 in an initial position wherein a minimum spacing between the annular surfaces 524 and 526 is defined by the physical dimensions of deflector plate 516 and supply header 502. When fluid pressure supplied to the apparatus 500 is increased, the increased downward force acting on deflector plate 516 will compress spring 522 to increase the spacing between annular surfaces 524 and 526.

In a typical example, the apparatus 500 will be designed with an initial minimum clearance between surfaces 524 and 526 at the peaks 530, 534 and 536 of one-half inch. The divider plate 544 will have a thickness of about one-quarter inch thus giving about one-eighth inch clearance above and below plate 544. Spring 522 will be chosen to allow a stroke of about one-half inch so that the maximum clearance between surfaces 524 and 526 will be about one inch.

It will be appreciated that in the absence of the automatic nozzle adjustment provided by spring 522 and the sliding engagement of plate 516 with support rod 510, that a substantial increase in fluid supply pressure would cause the spray pattern to be extended radially outward to an undue extent and would tend to create a void in the center of the pattern. Conversely, a decrease in flow supply pressure would cause the spray pattern to be reduced radially inward and would tend to create a void in the outer perimeter of the spray pattern. By appropriate choice of the spring rate of spring 522, the nozzle will automatically adjust the cross-sectional area of annular nozzle opening 528 so as to maintain a substantially uniform spray pattern over a wide range of fluid supply pressures and flow rates.

SUMMARY OF OPERATION

The spray distributing apparatus described above provide many advantages as compared to conventional multiple sprinkler grid work type distribution apparatus.

Figure 9:
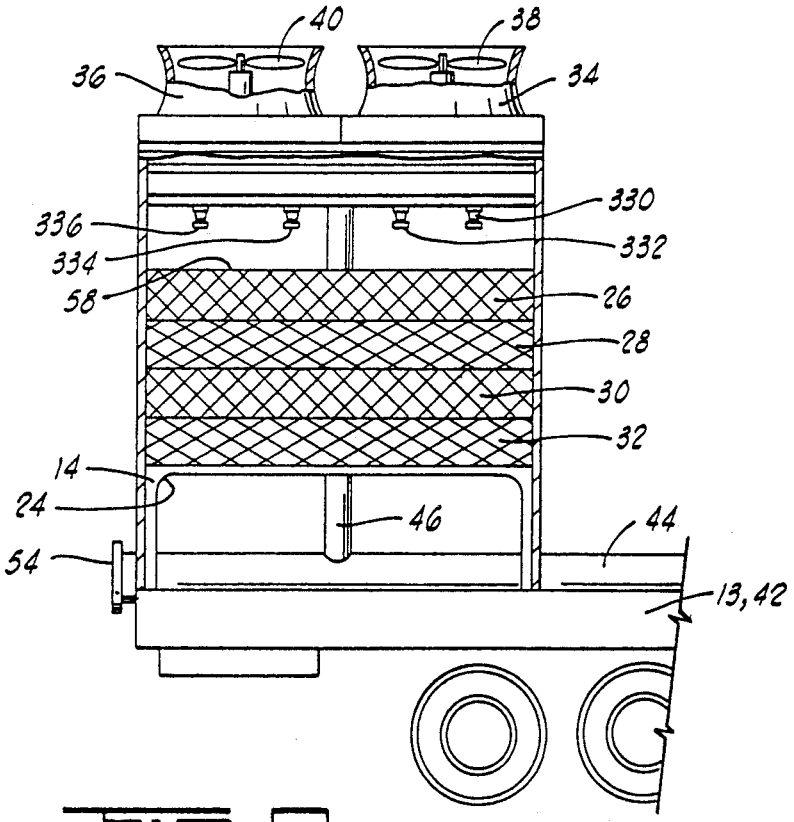
FIG. 9 (PRIOR ART)
FIG. 9 is an elevation sectioned somewhat schematic view of a typical prior art portable cooling tower having conventional overhead water distribution grid work with multiple sprinklers.

FIG. 9 illustrates a typical prior art portable cooling tower apparatus like that shown in Curtis U.S. Pat. Nos. 4,267,130 and 4,301,097, and particularly it illustrates the multiple sprinkler heads such as 330, 332, 334 and 336. It will be appreciated that these sprinklers are typically arranged in a grid across both the length and width of the upper surface 58 of the fill material 26.

One very significant advantage of the water distributor apparatus of the present invention as compared to prior art apparatus, is that the present apparatus is substantially clog free. It has no small fixed orifices like are commonly present in conventional sprinkler systems. The orifice of the present apparatus is in fact the annular spaces between the slinger plate 84 and the upper and lower limit surfaces 82 and 94. It will be appreciated that these relatively speaking are very large openings which are unlikely to clog. Furthermore, the rotating slinger plate 84 will serve to dislodge any debris that might flow into those openings. Further, since the slinger plate 84 is freely movable between the upper and lower limit surfaces 82 and 94, it can be deflected from its normal operating position to allow pieces of debris to be blown outward through the clearances between the slinger plate 84 and the upper and lower limit surfaces 82 and 94.

Another advantage is that the header 60 and the structure 72 and slinger plate 84 can all be made from non-corrosive materials such as fiberglass or injection molded plastic so that it does not corrode. This is another major advantage in the environment of industrial water cooling particularly.

Another advantage provided by the centralized fountain-type water distributing apparatus 55, 400 or 500 is that it provides a more uniform distribution of water across the upper surface 58 of the fill material 26 than does a conventional overhead multiple nozzle network like that shown in FIG. 9.

Yet another advantage is that the only moving part, i.e., the slinger plate 84, "floats" on water bearings and does not contact the other physical components such as header 60 and structure 72, and thus there are no wearable parts in the apparatus 55, 400 or 500.

Another major advantage is that the non-circular spray pattern defined by the fixed shroud 120 or by the irregular nozzle spacing of nozzle 500 allows the spray pattern to more uniformly fill the conventional rectangular plan shapes provided by most cooling towers. Again, this improves the efficiency of the tower as compared to a system like that of FIG. 9 where an attempt is made to cover a rectangular area with multiple circular patterns which necessarily cannot be efficiently done.

Many other advantages result from the various improvements in efficiency described above for the water distributing apparatus 55, 400 or 500 as compared to conventional overhead sprinkler-type apparatus like that of FIG. 9. Improved uniformity of water distribution across the upper surface 58 of the uppermost layer 26 of fill material may result in a reduction in the number of layers of fill material which is required. Even a reduction from four layers to three will provide very substantial savings in both the manufacturing costs and operating costs of the cooling tower. A reduction in the number of layers of fill material reduces the overall height of the structure thus reducing manufacturing costs. This reduces the head which must be overcome by supply pump 48 thus reducing operating costs. The reduced thickness in fill reduces obstruction to air flow, and thus reduces the power requirements for the fans 38 and 40. Less air flow requirement can also reduce the required height of the air inlet openings 24, thus providing further reduction in the overall size of the cooling tower.

Another advantage is that due to the clog-free nature of the water distributing apparatus 55, 400 or 500, there will be far less reduction in efficiency of the overall cooling tower system as time passes, in comparison to a conventional system like that of FIG. 9 where the sprinklers 330–336 will tend to clog over time. The nozzle of the present invention has a much larger opening than conventional nozzles, plus the rotating, floating, slinger plate 84 will tend to clean debris out of the nozzle.

Although the apparatus 55, 400 and 500 have been primarily disclosed herein in the context of industrial water cooling towers, it will be appreciated that in the broader aspects of the invention they may be utilized in many different situations. Other liquids, such as various chemicals, could be handled. Scaled-down versions of the apparatus could be utilized for lawn sprinkler systems. Another application of the water distributor apparatus is for aeration of water such as in effluent treatment ponds or in ponds used to raise catfish or other aquatic creatures. Metallic or ceramic distributors could be constructed for high temperature operation. Further, it will be appreciated that due to its clog-free nature, the fluid distributing apparatus is not necessarily limited to distribution of liquids such as water, but it could in fact be used to distribute fluidized solids such as grain or the like.

Thus it is seen that the apparatus of the present invention readily achieve the ends and advantages mentioned as well as those inherent therein. While certain preferred embodiments of the invention have been illustrated and described for purposes of the present disclosure, numerous changes in the arrangement and construction of the invention may be made by those skilled in the art, which changes are encompassed within the scope and spirit of the present invention as defined by the appended claims.

What is claimed is:

1. A fluid distributing apparatus, comprising:

first and second surfaces spaced apart to define an annular nozzle opening therebetween;

said first surface being an irregular surface shaped so that a spacing between said first and second surfaces varies around a circumference of said annular nozzle opening to create a non-circular spray pattern of fluid exiting said nozzle opening; and a rotatable plate located between said first and second surfaces and freely movable between said first and second surfaces, said plate having a central opening defined therethrough.

2. The apparatus of claim 1, wherein:

said irregular shaped first surface is shaped so that said non-circular spray pattern is a generally square pattern.

3. The apparatus of claim 1, wherein:

said irregular shaped first surface is an undulating surface having four peaks substantially equally spaced about said circumference, and having four troughs located between said peaks, said troughs also being substantially equally spaced about said circumference.

4. The apparatus of claim 3, wherein:

said second surface has a radially outermost edge lying substantially in a plane.

5. The apparatus of claim 3, wherein:

the spacing between said first and second surfaces at each of said troughs is substantially equal.

6. The apparatus of claim 1, further comprising:

a supply header having a fluid outlet defined therein, one of said first and second surfaces being defined on said supply header and surrounding said fluid outlet.

7. The apparatus of claim 6, wherein:

said one surface is said irregular shaped first surface.

8. The apparatus of claim 7, wherein:

said fluid outlet is a downwardly directed fluid outlet.

9. The apparatus of claim 1, further comprising:

automatic adjusting means for increasing the spacing between said first and second surfaces in response to an increase in fluid pressure in said annular nozzle opening.

10. The apparatus of claim 9, further comprising:

first and second structures having said first and second surfaces, respectively, defined thereon; and wherein said automatic adjustment means includes:

sliding connector means for connecting said first and second structures while allowing relative sliding motion between said first and second structures in a direction parallel to a central axis of said annular surfaces; and resilient biasing means for resiliently opposing sliding motion of said second structure away from said first structure.

11. The apparatus of claim 1, further comprising:

said rotatable plate having a radially outer edge; and a plurality of impeller blades attached to said rotatable plate around said annular nozzle opening, each of said blades extending radially outward beyond said outer edge of said plate and extending above and below said plate.

12. The apparatus of claim 11, wherein:

each of said impeller blades includes a radially inner serrated edge for atomizing the fluid exiting said annular nozzle opening.

13. The apparatus of claim 11, wherein:

said impeller blades provide a means for deflecting some of the fluid exiting said annular nozzle opening radially inward toward a longitudinal axis of said annular nozzle opening to eliminate a central void in said spray pattern below said annular nozzle opening.

14. A fluid distributing apparatus, comprising:

first and second structures having first and second surfaces, respectively, defined thereon, said first and second surfaces being spaced apart to define an annular nozzle opening therebetween;

automatic adjusting means for increasing the spacing between said first and second surfaces in response to an increase in fluid pressure in said annular nozzle opening, said automatic adjusting means including:

sliding connector means for connecting said first and second structures while allowing relative sliding motion between said first and second structures in a direction parallel to a central axis of said surfaces; and resilient biasing means for resiliently opposing sliding motion of said first structure away from said second structure; and a rotatable plate located between said first and second structures and extending radially through said annular nozzle opening.

15. The apparatus of claim 14, wherein:

said resilient biasing means is a mechanical compression spring.

16. The apparatus of claim 15, further comprising:

means for adjusting a spring rate of said mechanical compression spring.

17. The apparatus of claim 14, further comprising:

said rotatable plate having a radially outer edge; and a plurality of impeller blades attached to said rotatable plate around said annular nozzle opening, each of said blades extending radially outward beyond said outer edge of said plate and extending above and below said plate.

18. The apparatus of claim 14, wherein:

a minimum spacing defining said annular nozzle opening between said first and second surfaces is defined by engagement of said first structure with said second structure.

19. The apparatus of claim 18, further comprising:

said rotatable plate having a thickness less than said minimum spacing.

20. A fluid distributing apparatus, comprising:

a supply header having a fluid outlet defined therein and having a first annular surface defined on said supply header and surrounding said fluid outlet;

a support rod connected to said supply header and extending coaxially from said fluid outlet;

a deflector plate having a central bore which slidably receives said support rod, said deflector plate having a second annular surface defined thereon so that an annular nozzle opening is defined between said first and second annular surfaces; and a compression spring disposed about said support rod on a side of said deflector plate opposite said fluid outlet, said compression spring being compressible by increasing pressure of fluid passing through said nozzle opening to increase the spacing between said first and second annular surfaces.

21. The apparatus of claim 20, wherein:

said supply header includes a spider hub having a spider hub bore, said support rod being received through said spider hub bore, said spider hub having an axially outer end;

said deflector plate includes a deflector plate hub having a deflector plate hub bore, said deflector plate hub having an axially inner end, and said support rod being slidably received through said deflector plate hub bore; and a minimum spacing between said first and second annular surfaces is defined by engagement of said axially inner end of said deflector plate hub with said axially outer end of said spider hub.

22. The apparatus of claim 20, further comprising:

a nut threadedly engaged with said support rod on a side of said compression spring opposite said deflector plate so that a spring rate of said compression spring can be adjusted by varying a threaded engagement of said nut with said support rod.

* * * * *